United States Patent [19]

Shlesinger, Jr. et al.

[11] 3,943,474

[45] Mar. 9, 1976

[54] REED AND REED SWITCH THEREFOR

[76] Inventors: Bernard Edward Shlesinger, Jr., 9411 Macklin Court, Alexandria, Va. 22309; Charlie D. Mariner, 121 Garrison St., Bolling Air Force Base, Washington, D.C. 20336

[22] Filed: Dec. 16, 1974

[21] Appl. No.: 533,223

Related U.S. Application Data

[62] Division of Ser. No. 404,612, Oct. 9, 1973.

[52] U.S. Cl. ..... 335/151; 335/154

[51] Int. Cl.[2] ..... H01H 51/28

[58] Field of Search ..... 335/151, 153, 154, 205, 335/207; 200/283

[56] References Cited

UNITED STATES PATENTS

| | | | |
|---|---|---|---|
| 2,264,746 | 12/1941 | Ellwood | 335/154 |
| 2,922,856 | 1/1960 | Karrer | 335/154 |
| 3,283,274 | 11/1966 | DeFalco | 335/206 |
| 3,359,385 | 12/1967 | Bentz et al. | 335/205 |
| 3,760,312 | 9/1973 | Shlesinger, Jr. | 335/205 |

*Primary Examiner*—Harold Broome
*Attorney, Agent, or Firm*—Shlesinger, Arkwright, Garvey & Dinsmore

[57] ABSTRACT

A reed for a reed switch which comprises a body of conductive material having a contact section, an intermediate spring section, and a support section with the intermediate section being foil-thin and a contact section being substantially rigid and non-flexible and thicker than the intermediate section, and the intermediate section comprises a leaf spring having a flexibility permitting one end of the leaf spring to flex a substantial distance through an arc with respect to the other end of the leaf spring without exceeding the elastic limits of the spring, and the intermediate section being cold-worked to a point where said conductive material assumes a substantial change in physical characteristics, and said intermediate section is substantially harder, less ductile, and more dense than the contact section, and the body of said reed being of magnetic material. The invention also includes a reed switch in which the reed is mounted in association with a second conductive non-magnetic material reed and further is intended to include a magnetic operator for moving the magnetic reed into contact with the non-magnetic reed.

53 Claims, 28 Drawing Figures

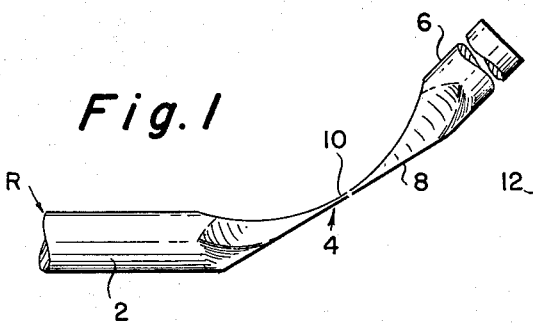
Fig. 1
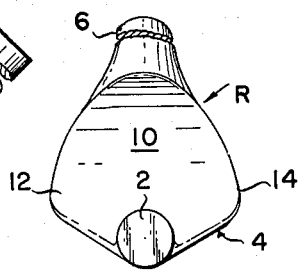
Fig. 2
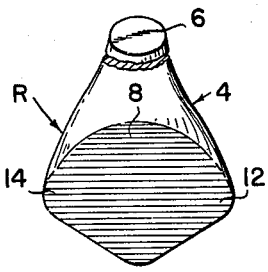
Fig. 3
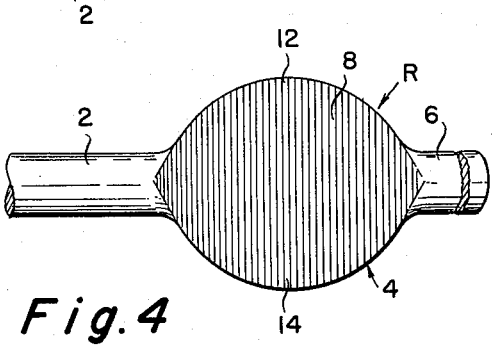
Fig. 4
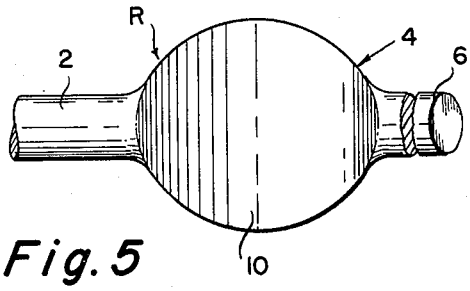
Fig. 5
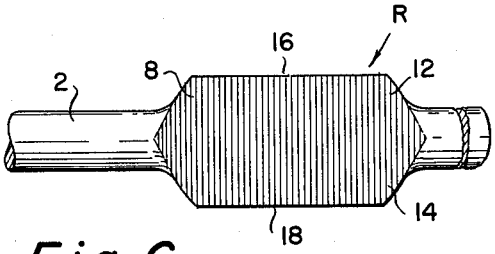
Fig. 6
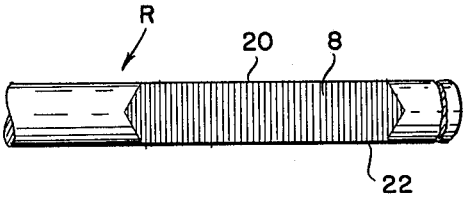
Fig. 7
Fig. 8
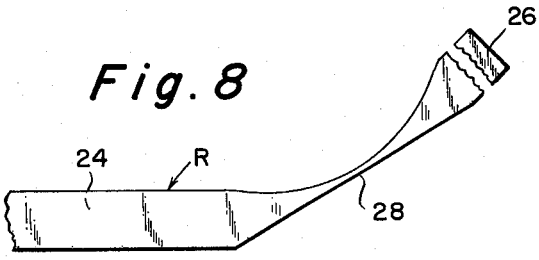
Fig. 9
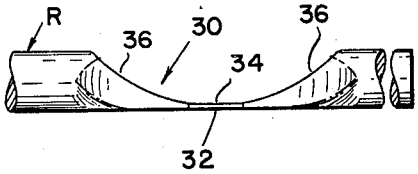
Fig. 10
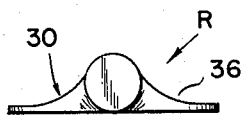
Fig. 11
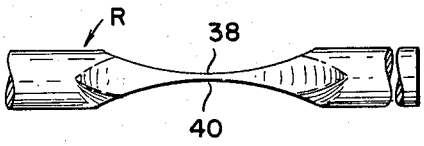
Fig. 12
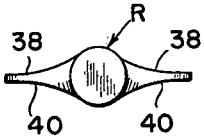

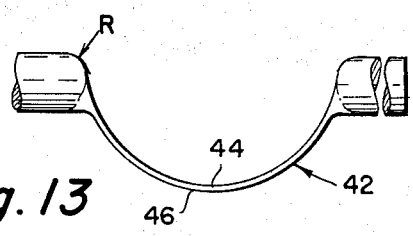
Fig. 13
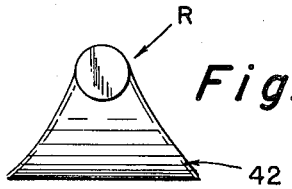
Fig. 14
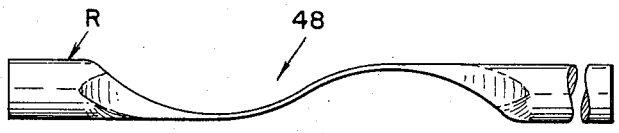
Fig. 15
Fig. 16
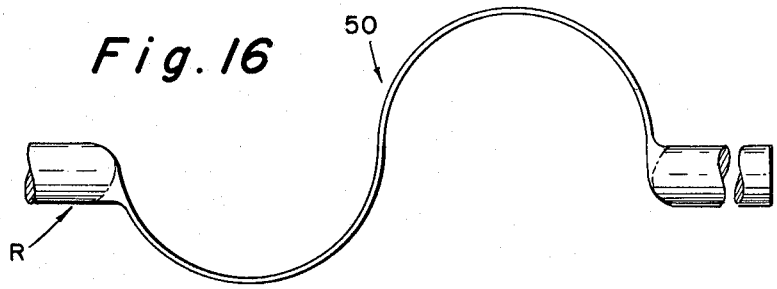
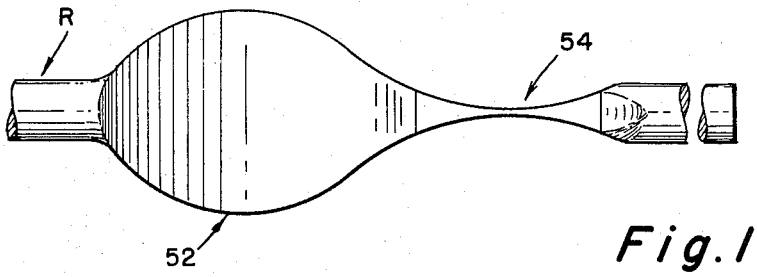
Fig. 17
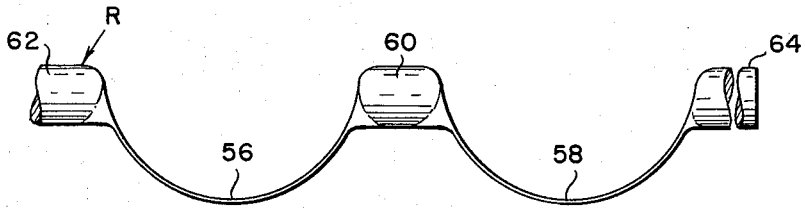
Fig. 18

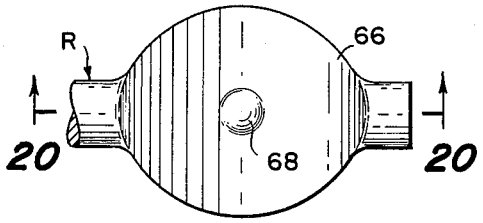
Fig. 19
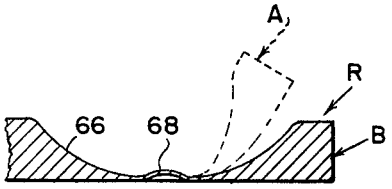
Fig. 20
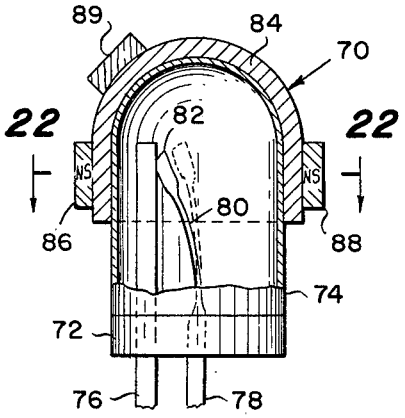
Fig. 21
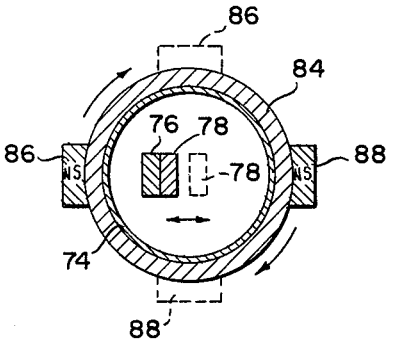
Fig. 22
Fig. 24
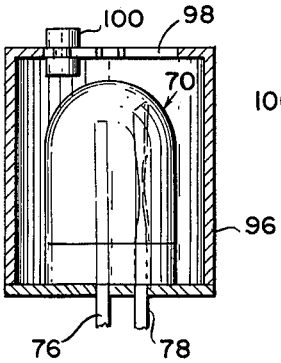
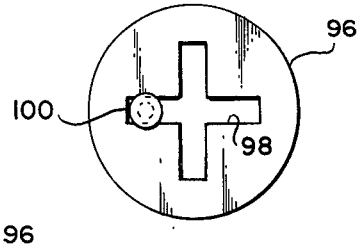
Fig. 25
Fig. 23
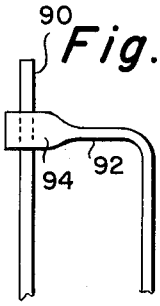
Fig. 23a
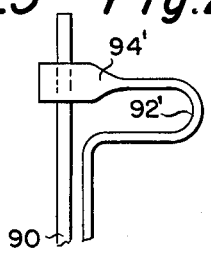
Fig. 26
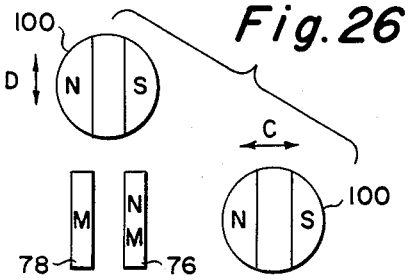
Fig. 27
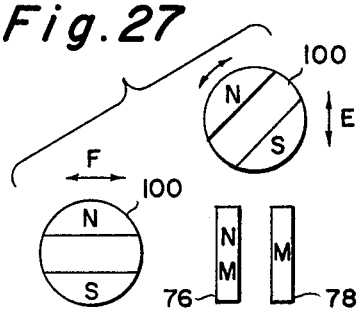

REED AND REED SWITCH THEREFOR

This is a division of application Ser. No. 404,612, filed Oct. 9, 1973.

FIELD OF INVENTION

This invention relates to reeds and reed switches, and more specifically to more compact and higher capacity reed devices.

HISTORICAL BACKGROUND

Reduced areas in reed switches are noted in such patents as Scheepstra et al. U.S. Pat. No. 3,258,557, Gomperts et al. U.S. Pat. No. 3,218,406, DeFalco U.S. Pat. No. 3,283,274 and Bianco et al. U.S. Pat. No. 3,059,074. Such flattened portions have been devised to aid in making the reed elements flexible as mentioned in DeFalco or to provide a limited pivot for an armature as illustrated in Gomperts et al. Gomperts in general provided a thin or flat piece of resilient metal attached to the armature and attached to the reed. This particular patent suggests a "scheme" from which the spring and reed could be made from one piece but it does not include the armature. Scheepstra et al. teaches the flattening of the reed to 0.15 mil. by pressure in order to obtain additional flexibility to his reeds. In general, however, the prior art failed to achieve any major reduction in size in reed switches. DeFalco and Van Wagener et al. U.S. Pat. No. 3,247,343 developed reed switches in which the reeds were mounted in the envelope at one end thereof only; however, no major decrease in length was accomplished by either of these developments. The smallest reed switch available today has reeds extending from either end of the envelope.

For many years, reed switch manufacturers have been attempting to reduce the size while increasing the load carrying capacity of the reed switches, but with little success.

OBJECTS AND SUMMARY

It is therefore an object of this invention to provide a reed and a reed switch therefor which allows for greater reduction in size and an increase in load carrying capacity substantially greater than heretofor.

It is a further object of this invention to provide a reed for a reed switch assembly which can be inexpensively and readily manufactured.

Another object of this invention is to provide a reed for a reed switch which has great durability and which can take severe strain and stresses.

Yet a further object of this invention is to provide a reed switch which provides for little or no contact bounce.

Yet another object of this invention is to provide a reed switch which incorporates therein a magnetic conductive reed and a non-magnetic conductive reed thereby providing for rapid make and break unachievable with prior reed switches in which the reeds are both of magnetic conductive material.

Still a further object of this invention is to provide a reed switch which has incorporated in itself a fuse feature for controlling overloads without causing damage to electrical components used in conjunction therewith by providing a highly audible signal at the moment of disintegration.

A still further object of this invention is to provide a reed switch which has little or no capacitance effect so necessary in utilization with integrated circuits and the like.

It is a further object of this invention to provide a reed switch which has an extremely rapid closing time.

Yet another object of this invention is to provide a reed switch in which the spring element of the reed has been cold-worked so as to completely change the crystalline structure of the metal in the area of the cold work to provide a spring which is durable and extremely flexable.

Yet another object of this invention is to provide a reed switch in which the flex of the arc at the end of the reed may exceed as much as 180°.

A further object of this invention is to provide a reed switch having contacts at the same end of the capsule thereby permitting substantial reduction in size.

Yet another object of this invention is to provide a reed switch in which the magnetic operator has different modes or phases of operation merely by rotating the axis of the magnetic operator with respect to the reeds.

Another object of this invention is to provide a reed switch in which the operator by repositioning can be made to close the switch or leave the switch in open position when moved through the same path.

A further object of this invention is to provide a reed switch in which the operator includes magnetic reenforcing means to increase the snap action of the switch.

Yet another object of this invention is to provide a reed switch which has a strong snap action so as to crunch or otherwise break through any oxide build-up thereby increasing the longevity of the switch and eliminating malfunction due to carbon build-up.

Yet a further object of this invention is to provide a reed for a reed switch which slams hard into its mating contact so as to give improved conductivity characteristics with use.

A further object of this invention is to provide a reed for a reed switch in which the spring principle can be adapted to many shapes and forms for various configurations of reed switches.

Still a further object of this invention is to provide a reed switch which has a past-dead-center mechanism so as to afford a two position reed.

Yet a further object of this invention is to provide a reed switch which can flex in more than one direction and which can even assume a flex in 360° although the reeds themselves may be flat.

Yet another object of this invention is to provide a reed switch which has a fuse member therein which fuse member can be modified for different current capacities.

A still further object of this invention is to provide a reed switch in which the non-magnetic conductive reed is provided with a flattened end portion for providing better contact and better current carrying capabilities.

Another object of this invention is to provide a reed switch in which the operator is in the form of a cap which sits on top of the reed envelope thereby providing for reduced profile.

In summary therefore, this invention is directed to reed switches having greater durability and greater carrying capacity and these and other objects of this invention will be apparent from the following description and claims.

In the accompanying drawing which illustrates by way of example various embodiments of this invention:

FIG. 1 is a side elevational view of the invention with the ends shown fragmentary on one end and broken away on the other end to show indeterminate length;

FIG. 2 is a right end view thereof;

FIG. 3 is a left end view thereof;

FIG. 4 is a bottom plan view thereof;

FIG. 5 is a top plan view thereof;

FIGS. 6 and 7 are bottom plan views of other modifications of this invention in which the ends are shown fragmentary on one end and broken away at the other end to show indeterminate length;

FIGS. 8 and 9 are side elevational views of further embodiments of the invention in which the ends are shown fragmentary on one end and broken away at the other end to show indeterminate length;

FIG. 10 is an end view of the embodiment shown in FIG. 9;

FIG. 11 is a side elevational view of a further embodiment of the invention with the ends being shown fragmentary on one end and broken away at the other to show indeterminate length;

FIG. 12 is an end view of the embodiment shown in FIG. 11;

FIG. 13 is a side elevational view of a further embodiment of the invention in which the ends are shown fragmentary at one end and broken away at the other end to show indeterminate length;

FIG. 14 is an end view of the embodiment shown in FIG. 13;

FIGS. 15, 16, 17 and 18 are side elevational views of further embodiments of the invention with the ends shown fragmentary at one end and broken away at the other end to show indeterminate length;

FIG. 19 is a top plan view of a further modification of the invention with the ends shown fragmentary;

FIG. 20 is a fragmentary cross sectional view of the embodiment shown in FIG. 19 taken along the lines 20—20 and viewed in the direction of the arrows;

FIG. 21 is a side elevational view showing one reed in closed position in solid lines and in open position in phantom lines with the ends of the reeds fragmentated;

FIG. 22 is a cross sectional view of the embodiment shown in FIG. 21 and viewed in the direction of the arrows;

FIGS. 23 and 23A are further embodiments of the non-magnetic reed showing an L-shaped reed and a goosenecked-shaped reed respectively;

FIG. 24 is a side elevational view of yet another embodiment of the invention;

FIG. 25 is a top plan view of the embodiment shown in FIG. 24;

FIGS. 26 and 27 are diagrammatic views illustrating the reeds and magnetics of the device illustrated in FIGS. 24 and 25.

FIGS. 1 THROUGH 5

FIGS. 1 through 5 show in detail one form of the reed used in conjunction with the reed switch subsequently described. The reed R is provided with a shank or support portion 2 with an intermediate portion 4 and a contact or end portion 6. The reed R is preferably made from a magnetic material and it has been found that a soft steel is much more desirable than a hard steel. It is to be understood that the reed might be used for other purposes than in conjunction with a magnetic field and in these instances the reed might be made from plastic, non-magnetic materials and the like which can be cold-worked. It is to be noted that the reed R at the intermediate section 4 has a flat bottom 8 and a concave surface 10. The intermediate section 4 is formed by cold-working a wire or reed which may have various cross sectional configurations but as shown in FIGS. 1–5, is circular. The wire is cold-worked by pressure such as peening, hammering, drop-pressing or the like until the metal becomes foil-thin. There is a critical stage in which the cold-working changes the characteristics of the metal of the wire to produce a spring and steel substantially different crystalline structure than the original non-worked metal. It has been found that slightly working the metal to reduce the thickness of the wire by flattening does not by itself produce the desired spring characteristics. A slight reduction does give some flex at the intermediate point, but it is relatively negligible. Even reduction down to a relatively thin cross section is not sufficient to change the characteristics of the metal to produce a spring steel of great flexibility and long life. It has been found that a reduction of the metal to a thickness of less than 0.003 inch totally reconstitutes the metal into a fine, hair-spring leaf. The cold working makes the spring intermediate section 4 extremely hard and flexible. In the process of cold-working, the metal that is worked flows laterally to produce side flanges 12 and 14. In the preferred embodiments of this invention, a thinness of 0.001 inch or less is created in order to obtain the maximum flex. Even 0.003 inch is one-half the thickness of previous known developments such as Scheepstra U.S. Pat. No. 3,258,557 who mentions reduction to 0.15 mm which is approximately 0.006 inch. It has been found that unless a foil-thinness is achieved, the spring-like characteristics desired for operation of a switch is unachievable. Only slight flex is achieved by reduction to the thinness set out by Scheepstra and this is still to thick to give real fine, hair-spring characteristics. The resulting spring made by the cold-working for all practical purposes will not wear out and tests show substantial life even after 2 billion contact operations. It has been found that thickness of the initial wire has no bearing on flex since the wire must be reduced at the point of flex to the criticalities aforementioned.

In FIGS. 1–5, it will be noted that the flat, planer surface 8 is angularly disposed to the base or support section 2, as well as to the contact section 6. In normal formation, the metal at the intermediate section 4 tends to draw at either end of the intermediate section 4 in such a manner as to swing the ends towards the area of reduction and the concave surface 10. In actual production of the reeds, the wire 2 is laid against a flat surface and the die which produces the curved surface 10 is struck thereinto. The ends of the wire tend to lift up from the flat surface on either side thereof once the die has been released. The reed can be manufactured so that the ends and the intermediate section are all in alignment by overstressing if necessary.

It should be noted that the area of reduction at the intermediate section 4 should be of some substantial length and preferably the length of the intermediate section should be about four or more times the thickness of the wire. This provides the intermediate section with a hinge of sufficient length to flex large increments. At least 25° of flex must be achieved in order to provide good switching action. Above 30° is preferred for switches in which the capacitance effect is not too much of a problem. At least 60° of flex is desired for certain compact spacing arrangements with a substantial reduction in capacitances. 90° of flex affords much greater spacing characteristics with further reduction as to capacitance problems. 120° of flex allows for sufficient spacing to eliminate capacitances for all practical purposes. 150° of flex permits the reed to be utilized for special design concepts in switching and a flex of 180° or more permits additional unique switch design configurations heretofor unobtainable with existing reed developments. It is to be noted that the advantage of this particular reed development is that that arc of flex is much greater than any prior arc development and for all practical purposes, the switch in which the reed is used never requires a maximum flex of the reed. The reed therefore operates substantially below its maximum capabilities which thus enhances the life of the reed. For example, the normal arc for which the reed may move in a particular switch might be 60° whereas the maximum normal flex of the reed used in that particular switch might be 120°. The reed thus never exceeds or even approaches its capabilities as far as flex is concerned.

FIGS. 6 THROUGH 14

In FIG. 6, the reed R differs only from the reed of FIGS. 1–5 in that portions of the flanges 12 and 14 have been clipped to provide flat straight edges 16 and 18. It has been found that the reed may be used as a fuse and circuit breaker and calibration of the carrying capacities of the reed would depend upon the amount of clipping of the sides 16 and 18. In FIG. 7, the sides of 20 and 22 have been clipped flush to the wire stock diameter. When used as a fuse, the reed parts at the intermediate section with a loud report similar to a firecracker.

FIG. 8 shows a reed R manufactured from rod stock having flat sides 24 and 26. The intermediate section 28 spreads out in much the same manner as the intermediate section 4 of FIGS. 1–5.

FIGS. 9 and 10 show the intermediate section 30 with a flat central portion 32 as having a flat surface 34 in the concavity between the curved surfaces 36. It will be obvious that any one of the reeds previously or subsequently referred to may include a flat central protion 32 as illustrated in FIGS. 9 and 10.

FIGS. 11 and 12 show the reed R configured from both sides so that there are two concavities 38 and 40. This arrangement provides a hinge which will flip equally in both directions from the center point, whereas the developments shown in FIGS. 1–5 permit the magnetic reed to be offset substantially from its mating reed even though the contact portion may be in close proximity thereto. The reed R in FIGS. 11 and 12 is concavo-concave in configuration whereas the reeds in FIGS. 1–5 are plano-concave in configuration.

FIGS. 13 and 14 show a reed R having an intermediate portion 42 with a concave surface 44 and a convex surface 46 giving it a concavo-convex appearance.

FIGS. 15 THROUGH 18

FIG. 15 shows a modified reed R having been struck from opposite directions to produca a flat S-configuration 48.

FIG. 16 shows a modified version of FIG. 15 in which the reed R is of a looped S-configuration 50.

FIG. 17 shows a reed R with two intermediate connecting sections 52 and 54 set at right angles to each other. This particular configuration of the reed permits the reed to rotate about its axis 360°.

FIG. 18 shows a reed R having two concavo-convex areas 56 and 58 with an intermediate contact section 60. The reed of this configuration can be supported at ends 62 and 64 so that the contact area 60 flexes back and forth under the influence of a magnetic field, the contact section being supported by the spring sections 56 and 58.

FIGS. 19 AND 20

In FIGS. 19 and 20 the reed 4 is provided with an intermediate spring section 66 which has a button 68 struck in the reverse direction. The button 68 acts as a past-dead-center mechanism to permit the reed to lodge in either position A or B. The operation is similar to "crickets" or noise makers. This development is particularly advantageous where the magnetic field is withdrawn and contact is desired to be maintained.

FIGS. 21 AND 22

FIGS. 21 and 22 show a reed switch 70 having a base 72 and an envelope 74 which may be plastic or glass and provided with an inert atmosphere or a vacuum as desired. Reeds 76 and 78 are mounted in the base 72. Reed 76 is of non-magnetic conductive material such as copper or aluminum or the like. Reed 78 is of magnetic conductive material such as soft steel. The intermediate foil spring section 80 extends substantially from the base 72 to the contact section 82. Mounted on the envelope 74 is a cap 84 which is rotatable thereon. The cap 84 is provided with opposing magnets 86 and 88. Cap 70 may be constructed so that the magnets 86 and 88 need not be positioned directly opposite each other and magnet 89 is a replacement position for magnet 86. If reference is now made to FIG. 22, it will be noted when the magnets 86 and 88 are moved 90° to the positions shown in dash lines, the switch remains open. When the cap is rotated another 90° in either direction, the switch is closed again. It is to be noted that the magnetic reed 78 is mounted in the same half of the capsule 70. The reason is that the magnets 86 and 88 reenforce each other and tend to cause the contact 82 to move more rapidly towards the reed 76. The reed 78 may be mounted in the other half of the capsule providing that the contact portion 82 extends into the same half in which the reed 76 is positioned. The magnetic influence therefore is operating primarily on the mass of the contact section 82 to drive it into contact with the non-magnetic conductive reed 76.

FIGS. 23 AND 23A

FIG. 23 shows the magnetic reed 90 engaging the non-magnetic reed 92. The non-magnetic reed 92 is L-shaped and is provided with a flattened contact surface area 94. This flattened contact area gives better conduction and action. In FIG. 23A, the reed 92' which is provided with a flattened area 94' similar to FIG. 23 has a hook-shaped configuration rather than an L-shaped configuration as illustrated in FIG. 23. The advantages of these type reeds are that they reduce capacitance in that the mass as of the reeds can be spaced a considerable distance from each other.

FIGS. 24 THROUGH 27

In FIG. 24, the reed switch 70 is mounted in a housing or support 96 which has a cruciform slot 98 in which is mounted a magnet 100. The magnet is round in configuration (although other forms may be used) and is slotted to be movable in the cruciform slot 98. It will now be observed with reference to FIG. 26, that as the magnet 100 is moved to the left in the direction of arrow C, contact will be made between the reeds as the magent 100 is passed from one end of the cruciform slot 98 to the other as long as the axis of the lines of flux are transverse to the planes of the reeds. It will also be noted that the movement of the magnet 100 in the left direction of the arrow C towards first the non-magnetic reed will first tend to push the magnetic reed 78 to the left and as the magnet is shifted further, the magnetic reed 78 will suddenly snap from one pole towards the other pole to close magnetic reed 78 on non-magnetic reed 76. The action is of course reversed as soon as the movement of the magnet is shifted to the right as in arrow C. If the magnet 100 with its poles oriented as illustrated, is positioned above the reeds 76 and 78 and is shifted in the downward direction of arrow D, and if the magnet is sufficiently offset to the right, the reed 78 will be drawn towards the reed 76.

With reference to FIG. 27, it will now be noted that if the magnet 100 is rotated slightly on its axis and placed at the top of the cruciform slot 98, and then shifted in the direction of the arrow E downwardly, the magnet will permit operation of the switch in that the polar field of the magnet is not exactly 90° to the planes of the magnet, but is at an angle thereto which permits the magnet 100 to operate the reed 78. It will be noted that the magnetic field should be in the direction of the magnetic reed 78 in order to begin to move it away from non-magnetic reed 76 prior to its snapping closed when the magnet 100 is continued to moved past the reeds 76 and 78 to permit the magmetic reed 78 to snap back on reed 76. It is to be further noted that the positioning of the magnet 100 for movement in the direction of the arrow F with its poles as illustrated so that the magnetic field is parallel to the planes of the reeds 76 and 78, will upon shifting to the right, fail to operate the reeds, since the magnetic field is parallel to the planes of the reeds 76 and 78.

It will be obvious that the reed and switches in which the reeds can be utilized, provide substantial reduction in size for the reed R. The reeds R need only be mounted so that the spring contact section is projecting from the base support. This allows very compact reed switch mechanisms to be built. It is anticipated that for maximum flex of between 25° of arc and more than 180° of arc, the intermediate section should have a length of between ⅛ to 1/32 inch. The thickness of the intermediate section may be uniform throughout substantially its entire length by utilization of certain type dies which may be of box-type configuration rather than arcuate or arcuate with flat surfaces. In general, even for loads of two amps, the overall length of the intermediate and contact sections should not exceed ½ inch. For the most part, the capsules need not exceed ½ inch in length nor ¼ inch in width.

While this invention has been described, it will be understood that it is capable of further modification, and the application is intended to cover any variations, used and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What we claim is:

1. A reed switch comprising:
a. a first reed of conductive magnetic material
b. a second reed of conductive non-magnetic material mounted in cooperating spaced relation to said first reed
c. said first reed comprising a body of conductive material having a contact section, an intermediate spring section, and a support section
d. said intermediate section being foil-thin
e. said support section being substantially rigid and non-flexible
f. said contact section being substantially thicker than said intermediate section
g. said intermediate section comprising a leaf spring having a flexibility permitting one end of said leaf spring to flex a substantial distance through an arc with respect to the other end of said leaf spring without exceeding the elastic limits of said spring
h. said intermediate section being cold-worked to a point where said conductive material assumes a substantial change in physical characteristics, and
i. said intermediate section being substantially harder, less ductile, and more dense than said contact section and having a substantiall higher tensile strength than said contact section.

2. A reed switch as in claim 1 and wherein:
a. said reeds are capsulated and extend in the same direction and have bases mounted adjacent each other.

3. A reed switch as in claim 1 and wherein:
a. said conductive material is soft steel.

4. A reed switch as in claim 1 and wherein:
a. said support section is substantially rigid and non-flexible and substantially thicker than said intermediate section, and
b. said intermediate section is substantially harder, less ductile, and more dense than said support section and having a substantially higher tensile strength than said support section.

5. A reed switch as in claim 4 and wherein:
a. said sections are integral and formed in a single piece.

6. A reed switch as in claim 1 and wherein:
a. said intermediate section has a maximum flex of at least 25° of arc.

7. A reed switch as in claim 1 and wherein:
a. said intermediate section has a maximum flex of at least 30° of arc.

8. A reed switch as in claim 1 and wherein:
a. said intermediate section has a maximum flex of at least 60° of arc.

9. A reed switch as in claim 1 and wherein:
a. said intermediate section has a maximum flex of between about 90° of arc and 180° of arc.

10. A reed switch as in claim 1 and wherein:
a. said intermediate section has substantially uniform thickness throughout a major portion of its length.

11. A reed switch as in claim 1 and wherein:
a. said intermediate section thickens towards its ends.

12. A reed switch as in claim 1 and wherein:
a. said intermediate section is concavo-concave.

13. A reed switch as in claim 1 and wherein:
a. said intermediate section is plano-concave.

14. A reed switch as in claim 1 and wherein:
a. said intermediate section is concavo-convex.

15. A reed switch as in claim 1 and wherein:
a. said sections are axially aligned.

16. A reed switch as in claim 1 and wherein:

a. said contact section is angularly disposed with respect to said support section.

17. A reed switch as in claim 1 and wherein:

a. each of said sections are angularly disposed to each other.

18. A reed switch as in claim 1 and wherein:

a. said intermediate section includes flat and curved surfaces.

19. A reed switch as in claim 1 and wherein:

a. said intermediate section includes a past-dead-center mechanism.

20. A reed switch as in claim 1 and wherein:

a. the overall length of said intermediate section is between about one-eighth to one-thirty second inch.

21. A reed switch as in claim 1 and wherein:

a. said intermediate section has a cross sectional thickness of less than 0.003 inches, and b. said leaf spring has a flexibility permitting one end of said leaf spring to flex through an arc of at least 25°.

22. A reed switch as in claim 21 and wherein:

a. said reeds are capsulated and extend in the same direction and have bases mounted adjacent each other.

23. A reed switch as in claim 21 and wherein:

a. said conductive material is soft steel.

24. A reed switch as in claim 21 and wherein:

a. said support section is substantially rigid and non-flexible and substantially thicker than said intermediate section, and b. said intermediate section is substantially harder, less ductile, and more dense than said support section and having a substantially higher tensile strength than said support section.

25. A reed switch as in claim 21 and wherein:

a. said sections are integral and formed in a single piece.

26. A reed switch as in claim 21 and wherein:

a. said intermediate section has substantially uniform thickness throughout a major portion of its length.

27. A reed switch as in claim 21 and wherein:

a. said intermediate section thickens towards its ends.

28. A reed switch as in claim 21 and wherein:

a. said intermediate section is concavo-concave.

29. A reed switch as in claim 21 and wherein:

a. said intermediate section is plano-concave.

30. A reed switch as in claim 21 and wherein:

a. said intermediate section is concavo-convex.

31. A reed switch as in claim 21 and wherein:

a. said sections are axially aligned.

32. A reed switch as in claim 21 and wherein:

a. said contact section is angularly disposed with respect to said support section.

33. A reed switch as in claim 21 and wherein:

a. each of said sections are angularly disposed to each other.

34. A reed switch as in claim 21 and wherein:

a. said intermediate section includes flat and curved surfaces.

35. A reed switch as in claim 21 and wherein:

a. said intermediate section includes a past-dead-center mechanism.

36. A reed switch as in claim 21 and wherein:

a. the overall length of said intermediate section is between about one-eighth to one-thirty second inch.

37. A reed switch as in claim 1 and wherein:

a. said intermediate section has a cross sectional thickness of less than about 0.001 inches.

38. A reed switch as in claim 37 and wherein:

a. said reeds are capsulated and extend in the same direction and have bases mounted adjacent each other.

39. A reed switch as in claim 37 and wherein:

a. said conductive material is soft steel.

40. A reed switch as in claim 37 and wherein:

a. said support section is substantially rigid and non-flexible and substantially thicker than said intermediate section, and b. said intermediate section is substantially harder, less ductile, and more dense than said support section and having a substantially higher tensile strength than said support section.

41. A reed switch as in claim 37 and wherein:

a. said sections are integral and formed in a single piece.

42. A reed switch as in claim 37 and wherein:

a. said intermediate section has substantially uniform thickness throughout a major portion of its length.

43. A reed switch as in claim 37 and wherein:

a. said intermediate section thickens towards its ends.

44. A reed switch as in claim 37 and wherein:

a. said intermediate section is concavo-concave.

45. A reed switch as in claim 37 and wherein:

a. said intermediate section is plano-concave.

46. A reed switch as in claim 37 and wherein:

a. said intermediate section is concavo-convex.

47. A reed switch as in claim 37 and wherein:

a. said sections are axially aligned.

48. A reed switch as in claim 37 and wherein:

a. said contact section is angularly disposed with respect to said support section.

49. A reed switch as in claim 37 and wherein:

a. each of said sections are angularly disposed to each other.

50. A reed switch as in claim 37 and wherein:

a. said intermediate section includes flat and curved surfaces.

51. A reed switch as in claim 37 and wherein:

a. said intermediate section includes a past-dead-center mechanism.

52. A reed switch as in claim 37 and wherein:

a. the overall length of said intermediate section is between about ⅛ to 1/32 inch.

53. A reed switch as in claim 37 and wherein:

a. said leaf spring flexes through an arc of at least 25°.

* * * * *